US010631625B1

(12) United States Patent
Alhajji

(10) Patent No.: US 10,631,625 B1
(45) Date of Patent: Apr. 28, 2020

(54) VIBRATING DISPENSING HAIRBRUSH

(71) Applicant: Hala F.H.Y. Alhajji, Safat (KW)

(72) Inventor: Hala F.H.Y. Alhajji, Safat (KW)

( * ) Notice: Subject to any disclaimer, the term of this patent is extended or adjusted under 35 U.S.C. 154(b) by 0 days.

(21) Appl. No.: 16/372,338

(22) Filed: Apr. 1, 2019

(51) Int. Cl.

| | |
|---|---|
| ***A45D 24/22*** | (2006.01) |
| ***A45D 24/24*** | (2006.01) |
| ***A46B 11/00*** | (2006.01) |
| ***A46B 13/02*** | (2006.01) |
| *A45D 24/00* | (2006.01) |

(52) U.S. Cl.
CPC ..... *A46B 11/0062* (2013.01); *A46B 13/023* (2013.01); *A45D 24/007* (2013.01); *A46B 11/002* (2013.01); *A46B 2200/104* (2013.01); *A46B 2200/40* (2013.01)

(58) Field of Classification Search
CPC ..... A45D 24/007; A45D 24/08; A45D 24/22; A45D 24/24; A45D 24/26; A45D 2200/207; A45D 19/02; A45D 2019/025; A01K 13/00; A01K 13/001; A01K 13/003; A46B 13/04; A46B 11/0062
USPC .... 132/112, 113, 108, 106, 119.1, 120, 163; 601/17, 134, 135; 119/602, 612, 615, 119/652; 401/183–186, 282, 290, 291
See application file for complete search history.

(56) References Cited

U.S. PATENT DOCUMENTS

| | | | | |
|---|---|---|---|---|
| 1,818,281 | A * | 8/1931 | Soss | A46B 11/066 15/22.1 |
| 2,922,425 | A | 1/1960 | Lerner et al. | |
| D318,180 | S | 7/1991 | Yip Kai-Wing | |
| 5,054,504 | A * | 10/1991 | Winrow | A45D 19/02 132/110 |
| D363,164 | S | 10/1995 | West | |
| 5,632,289 | A | 5/1997 | Sharp | |
| 5,927,290 | A | 7/1999 | Thiruppathi | |
| 6,675,812 | B1 | 1/2004 | Wiley | |

(Continued)

FOREIGN PATENT DOCUMENTS

| | | | | |
|---|---|---|---|---|
| DE | 202018105456 U1 * | 10/2018 | | A45D 24/22 |
| JP | H10327936 A | 12/1998 | | |

OTHER PUBLICATIONS

Piatetsky, Andre, Regrolix—Liquid-Dispensing Hairbrush, Aug. 10, 2014, Youtube, https://www.youtube.com/watch?v=FhxUsQ13fkQ (Year: 2014).*

(Continued)

*Primary Examiner* — Tatiana L Nobrega
*Assistant Examiner* — Sarah Woodhouse
(74) *Attorney, Agent, or Firm* — Richard C. Litman; Nath, Goldberg & Meyer

(57) ABSTRACT

The vibrating dispensing hairbrush has an elongated upper housing, a main body below the upper housing, and a removable bottom cover. The main body defines a fluid reservoir for holding a liquid to be dispensed while brushing. A bristle plate defines the bottom wall of the reservoir, the bristle plate having an alternating pattern of bristles and resilient nubs depending therefrom, the nubs dispensing drops of the fluid when pressure is applied thereto by the bristles while brushing. The upper housing houses a vibratory motor at opposite ends thereof for aiding in fluid dispensing and distribution, and for imparting vibratory motion to the bristles, and also houses rechargeable batteries. The bottom cover protects the bristles when not in use, and may have an accessory mirror attached thereto.

10 Claims, 5 Drawing Sheets

(56) References Cited

U.S. PATENT DOCUMENTS

| | | | | |
|---|---|---|---|---|
| 6,745,779 | B2 | 6/2004 | Piatetsky | |
| 7,805,794 | B2 | 10/2010 | Taggart et al. | |
| 9,295,228 | B1 * | 3/2016 | Schiermeier | A01K 13/001 |
| 9,486,062 | B1 | 11/2016 | Piatetsky | |
| 9,526,326 | B2 | 12/2016 | Neumann et al. | |
| 2003/0002913 | A1 | 1/2003 | Amit | |
| 2003/0102003 | A1 * | 6/2003 | Piatetsky | A46B 11/0006 132/111 |
| 2007/0095362 | A1 | 5/2007 | Koopah | |
| 2010/0004570 | A1 | 1/2010 | Torres-Martin | |
| 2017/0367923 | A1 * | 12/2017 | Bergbacka | A01K 13/00 |
| 2018/0168330 | A1 | 6/2018 | Davies-S. et al. | |
| 2018/0344020 | A1 * | 12/2018 | Sommer | A46B 11/0065 |

OTHER PUBLICATIONS

"Electric Vibration Hair Scalp Massager Brush", www.apalus.com/products-hairmassagerbrush-hc005.html (2015).

* cited by examiner

VIBRATING DISPENSING HAIRBRUSH

BACKGROUND

1. Field

The disclosure of the present patent application relates to hairbrushes, and particularly to a vibrating, dispensing hairbrush that dispenses a fluid from a reservoir through resilient nubs around the base of the bristles when pressure is applied to the bristles.

2. Description of the Related Art

The common hairbrush is one of the most frequently used hair care accessories, particularly for grooming. Most conventional hairbrushes have a rigid brush head from which the bristles extend and a handle extending from the brush head so that the user's hand is offset from the path of the bristles. Depending upon the condition of the hair, it may be desirable to wet that hair with water, conditioner, or some other fluid before or during brushing to ensure proper grooming, which adds additional steps and takes additional time. Also, some hair care professionals are of the opinion that it is helpful to gently massage the scalp during the brushing process to properly condition the hair, which is difficult to do with a conventional hairbrush.

Thus, a vibrating dispensing hairbrush solving the aforementioned problems is desired.

SUMMARY

The vibrating dispensing hairbrush has an elongated upper housing, a main body below the upper housing, and a removable bottom cover. The main body defines a fluid reservoir for holding a liquid to be dispensed while brushing. A bristle plate defines the bottom wall of the reservoir, the bristle plate having an alternating pattern of bristles and resilient nubs depending therefrom, the nubs dispensing drops of the fluid when pressure is applied thereto by the bristles while brushing. The upper housing houses a vibratory motor at opposite ends thereof for aiding in fluid dispensing and distribution, and for imparting vibratory motion to the bristles, and also houses rechargeable batteries. The bottom cover protects the bristles when not in use, and may have an accessory mirror attached thereto.

In use, the user removes the bottom cover and grips the upper housing/main body assembly to brush the hair. The upper housing has a power switch for turning on the vibratory motors to impart vibration as desired. The fluid reservoir has a refill plug for filling the reservoir with a fluid for wetting the hair while brushing, when desired. The fluid is dispensed when the resilient nubs are squeezed by the bristles while brushing. The accessory mirror may be used to view the progress of grooming. When brushing is complete, the bottom cover may be re-attached to protect the bristles, and a charging cable may be attached to a charging port on the upper housing to recharge the batteries, if needed.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
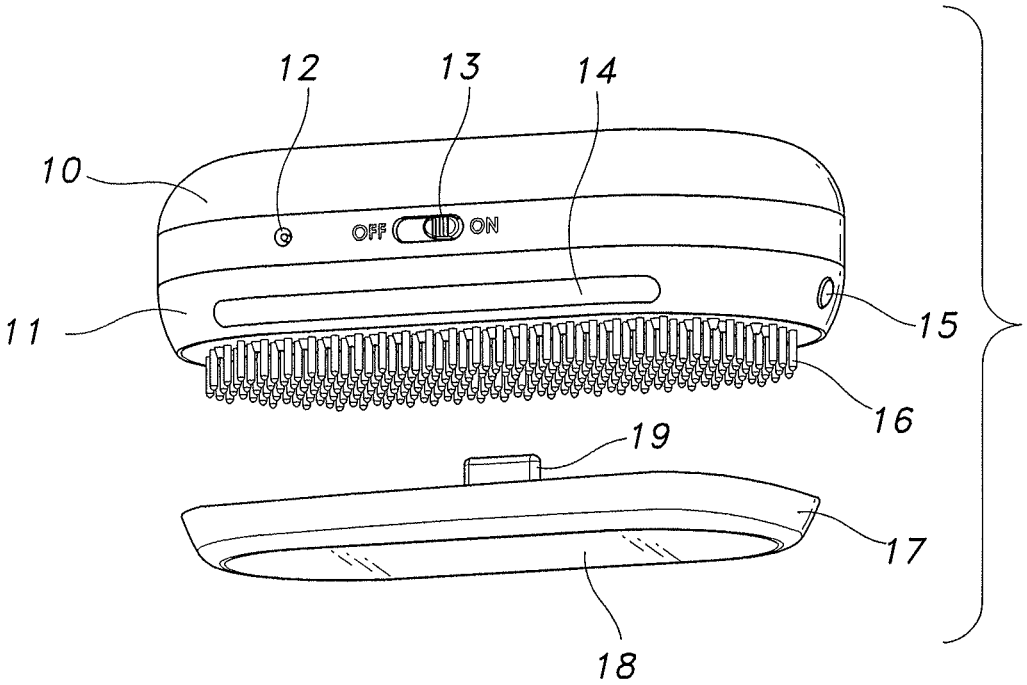
FIG. 1 is a partially exploded perspective view of a vibrating dispensing hairbrush, showing the bottom cover removed to expose the bristles.
Figure 3:
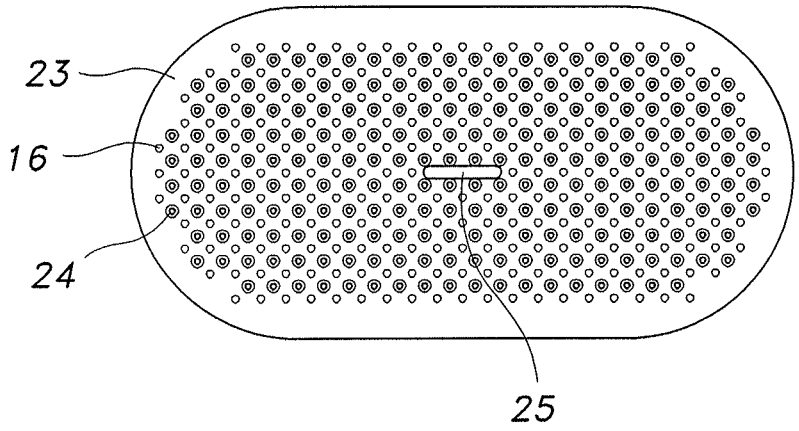
FIG. 3 is a top view of the bristle plate, showing staggered rows of bristles and resilient, liquid dispensing nubs.
Figure 5:
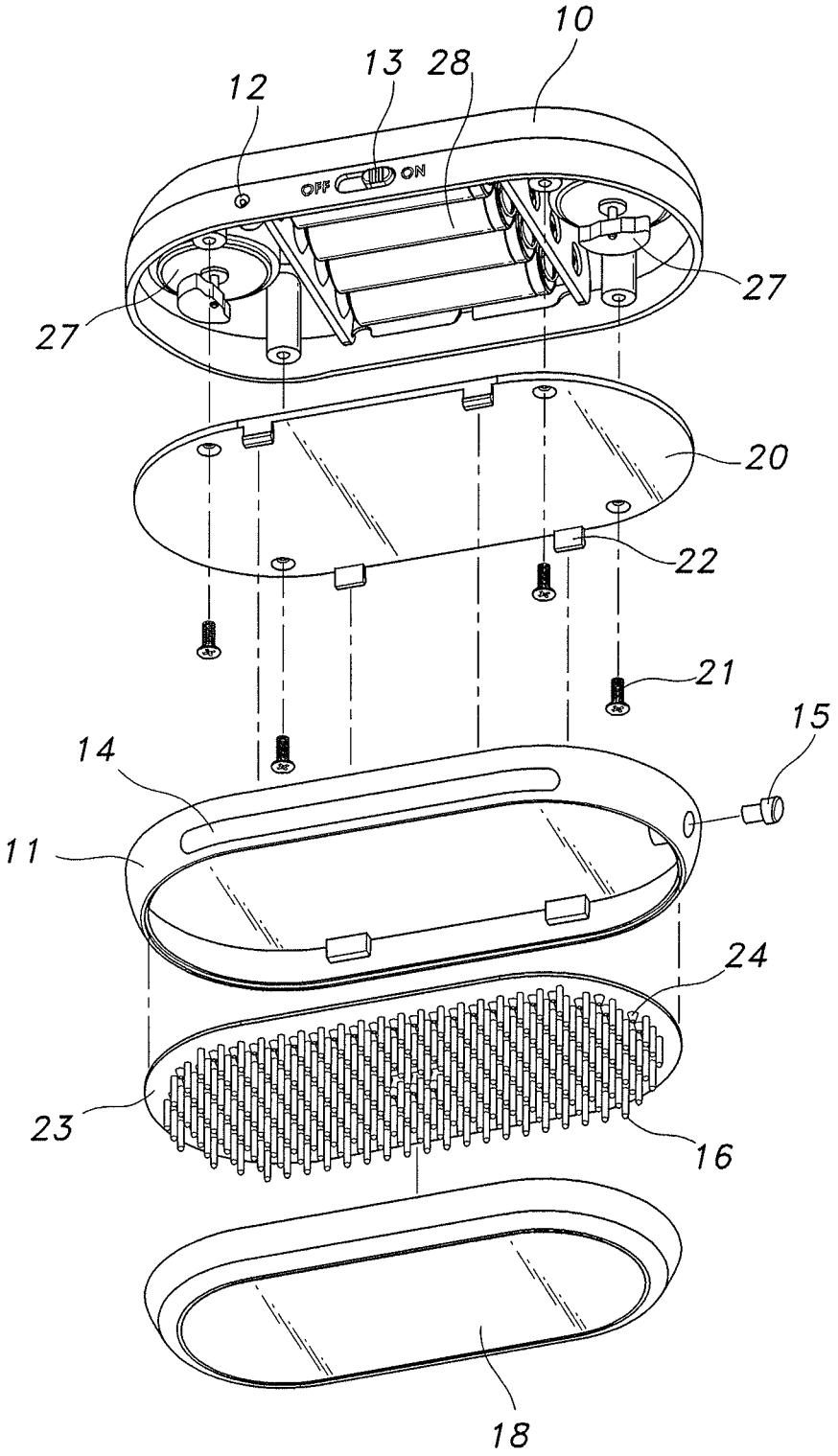
FIG. 5 is an exploded perspective view of the vibrating dispensing hairbrush of FIG. 1 as seen from below.

As shown in FIG. 1, the vibrating dispensing hairbrush has an elongated upper housing 10, a main body 11 below the upper housing 10, and a removable bottom cover 17. The main body defines a fluid reservoir 29 (best seen in FIGS. 6 and 7) for holding a liquid to be dispensed while brushing. A bristle plate 23 (shown in FIG. 3) defines the bottom wall of the reservoir 29, the bristle plate having an alternating pattern of bristles 16 and resilient nubs 24 depending therefrom, the nubs 24 dispensing drops of the fluid when pressure is applied thereto by the bristles 16 while brushing. The upper housing 10 houses a vibratory motor 27 at opposite ends thereof, as shown in FIG. 5, for aiding in fluid dispensing and distribution, and for imparting vibratory motion to the bristles 16, and also houses rechargeable batteries 28. The bottom cover 17 protects the bristles 16 when not in use, and may have an accessory mirror 18—attached thereto.

Figure 2:
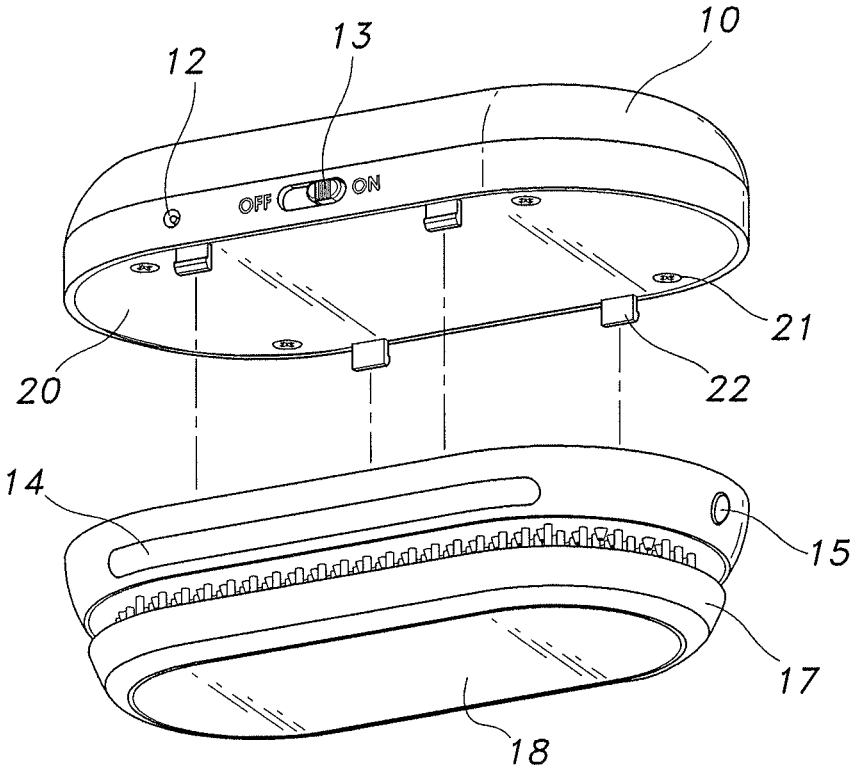
FIG. 2 is a partially exploded perspective view of the vibrating dispensing hairbrush of FIG. 1, showing the upper housing removed.
Figure 4:
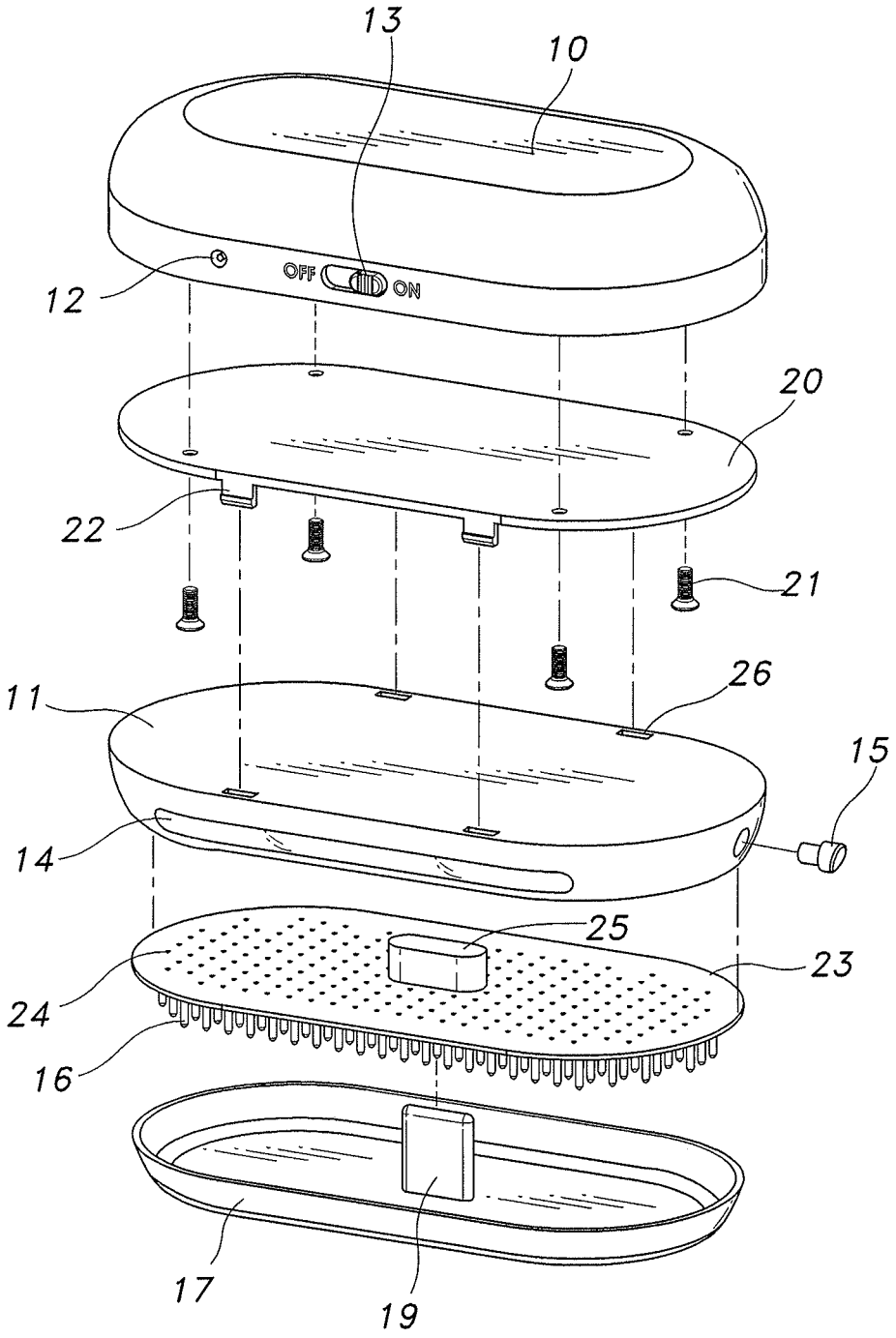
FIG. 4 is an exploded perspective view of the vibrating dispensing hairbrush of FIG. 1.

As shown in FIGS. 1, 2, and 4, the upper housing may have a charging port 12 connected to the rechargeable batteries 28 for attachment of a transformer (wall wart) or USB charging cable for recharging the batteries 28, and a power switch 13 for selectively turning the vibratory motor(s) 27 on and off. The vibratory motors 27 may be any type of vibratory motor known in the art, such as a motor having an eccentric weight attached to the shat of the motor. The upper housing 10 may have a bottom plate 20 attached thereto by screws 21 or other fasteners attached to suitable bosses extending downward from the roof of the upper housing 10.

As shown in FIG. 4, the bottom plate 20 of the upper housing 10 may have resilient clips 22 depending from its edges that snap into receptacles 26 defined in the main body 11. The main body may have a sight glass 14 disposed in a side there of for checking the level of fluid in the reservoir 29 visually, as well as a fill plug 15 for filling the reservoir 29 with water, hair conditioner, or other fluid to be dispensed while brushing. A plastic or rubber bristle plate 23 may be pressure fit into the opening as the bottom of the main body to provide the floor of the fluid reservoir 29.

Figure 6:
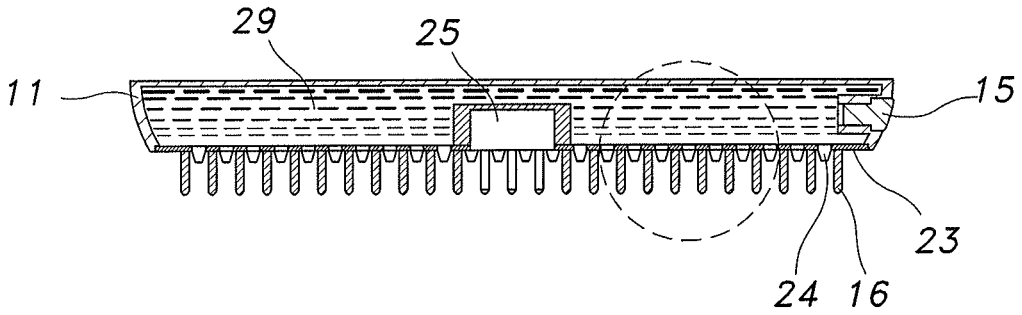
FIG. 6 is a front view in section of the main body of the vibrating dispensing hairbrush of FIG. 1.
Figure 7:
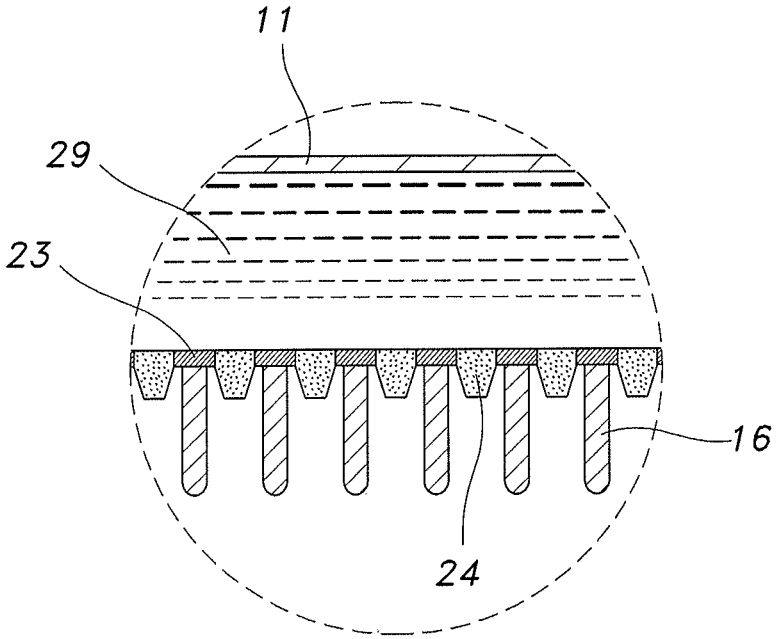
FIG. 7 is a detail section view of area 7 of FIG. 6.

As shown in FIGS. 4, 6, and 7, a plurality of bristles 16 and resilient nubs 24 are disposed in alternating, staggered rows and have one end extending through the bristle plate 23 so that the ends of the resilient nubs 24 are exposed to the fluid in the reservoir 29. The resilient nubs 24 may absorb or adsorb the fluid in the reservoir 29 until the nubs 24 become saturated with the fluid, a process that may be aided by agitating the fluid in the reservoir by turning on the vibratory motor(s) 27. The nubs 24 may be made from natural or artificial (synthetic) sponge or other absorbent material. The bristle plate 23 may also have a central receptacle 25 mounted therein, which may extend into the reservoir 29, as shown in FIG. 6. The receptacle 25 selectively receives a tang 19 extending upward from the bottom cover 17 in order to secure the bottom cover 17 to the main body 11 when the hairbrush is not in use.

In use, the user removes the bottom cover 17 and grips the upper housing/main body assembly to brush the hair. The upper housing 10 has a power switch 13 for turning on the vibratory motors 27 to impart vibration as desired, for agitating fluid in the reservoir 29, or for vibrating the bristles 16 to apply a gentle massage to the scalp or disentangle hair. The fluid reservoir 29 has a refill plug 15 for filling the reservoir with a fluid for wetting the hair while brushing, when desired. The fluid is dispensed when the resilient nubs 24 are squeezed by the bristles 16 while brushing. The accessory mirror 18 may be used to view the progress of grooming. When brushing is complete, the bottom cover 17 may be re-attached to protect the bristles 16, and a charging cable may be attached to the charging port 12 on the upper housing 10 to recharge the batteries 28, if needed.

It is to be understood that the vibrating dispensing hairbrush is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A vibrating dispensing hairbrush, comprising:

an elongated upper housing;

at least one vibratory motor disposed within the upper housing;

a bottom plate secured to the upper housing and enclosing the vibratory motor therein, the bottom plate defining a floor of the upper housing;

a main body attached to the bottom plate from below, the main body defining a fluid reservoir adapted for holding a liquid to be dispensed on hair while brushing the hair, wherein the fluid reservoir is the sole fluid reservoir in the vibrating dispensing hairbrush and is entirely coextensive with the main body, the main body having a bristle plate defining a floor of the reservoir, wherein the bristle plate is entirely coextensive with the main body, extending over the entire length and width of the main body;

a plurality of rows of bristles and a plurality of rows of resilient nubs protruding from the bristle pate in a direction away from the reservoir, wherein the rows of bristles and the rows of resilient nubs are arranged in an alternating and staggered arrangement, the resilient nubs having an upper end extending through the bristle plate so that the resilient nubs are exposed to and adapted for absorbing the liquid in the fluid reservoir; the resilient nubs dispense drops of the liquid between the bristles when squeezed by the bristles during brushing;

the bristle plate further comprises a central through-hole, a receptacle integrally protruding from a top surface of the bristle plate, immediately adjacent the through-hole, where the receptacle has side walls and a top wall forming an enclosure which extends into the fluid reservoir such that the liquid of the fluid reservoir does not flow through the receptacle; and a removable bottom cover selectively secured to the bristle plate to cover and protect all of the bristles and resilient nubs of the bristle plate when the hairbrush is not in use;

a tang extending from the removable bottom cover, the tang engaging the receptacle to selectively secure the bottom cover to the main body, wherein the rows of bristles and resilient nubs are disposed over the entirety of the bristle plate except along a peripheral portion of the bristle plate and the receptacle, wherein the upper housing and main body are gripped by a user when the hairbrush is used for brushing hair.

2. The vibrating dispensing hairbrush according to claim 1, wherein the at least one vibratory motor comprises two vibratory motors including a first motor and a second motor disposed at opposite ends of the elongated upper housing, respectively.

3. The vibrating dispensing hairbrush according to claim 1, further comprising a power switch mounted in said upper housing and connected to the at least one vibratory motor for selectively applying vibration to the bristles.

4. The vibrating dispensing hairbrush according to claim 1, further comprising at least one rechargeable battery disposed in the upper housing and a charging port mounted in said upper housing and connected to the at least one rechargeable battery for selectively recharging the battery.

5. The vibrating dispensing hairbrush according to claim 1, further comprising a sight glass disposed in the main body for viewing the level of liquid in the fluid reservoir.

6. The vibrating dispensing hairbrush according to claim 1, further comprising a refill plug mounted in the main body for refilling the fluid reservoir with a liquid to be dispensed while brushing.

7. The vibrating dispensing hairbrush according to claim 1, wherein the resilient nubs are made from natural or artificial sponge.

8. The vibrating dispensing hairbrush according to claim 1, further comprising an accessory mirror mounted on the removable bottom cover.

9. The vibrating dispensing hairbrush according to claim 1, wherein the bristle plate is made from plastic, the bristle plate being pressure fit into the main body to define the floor of the fluid reservoir.

10. The vibrating dispensing hairbrush according to claim 1, wherein the bristle plate is made from rubber, the bristle plate being pressure fit into the main body to define the floor of the fluid reservoir.

* * * * *